US005432402A

United States Patent [19]

An

[11] Patent Number: 5,432,402

[45] Date of Patent: Jul. 11, 1995

[54] CATHODE RAY TUBE

[75] Inventor: Min-ho An, Kwacheon-city, Rep. of Korea

[73] Assignee: Samsung Electron Devices Co., Ltd, Kyungki-do, Rep. of Korea

[21] Appl. No.: 302,956

[22] Filed: Sep. 12, 1994

Related U.S. Application Data

[63] Continuation of Ser. No. 950,493, Sep. 25, 1992, abandoned.

[30] Foreign Application Priority Data

Sep. 28, 1991 [KR] Rep. of Korea ..... 91-17014

[51] Int. Cl.[6] ..... H01J 29/86

[52] U.S. Cl. ..... 313/477 R; 313/461

[58] Field of Search ..... 313/461, 463, 477 R, 313/408; 220/2.1 A

[56] References Cited

U.S. PATENT DOCUMENTS

| | | | |
|---|---|---|---|
| 4,084,113 | 4/1978 | Vogelpohl | 313/477 R |
| 4,570,101 | 2/1986 | Campbell | 313/461 |
| 4,591,757 | 5/1986 | Bakker et al. . | |
| 4,777,401 | 10/1988 | Hosokoshi et al. . | |
| 4,839,556 | 6/1989 | Ragland, Jr. . | |
| 4,881,004 | 11/1989 | Inoue et al. | 313/477 R |
| 4,887,001 | 12/1989 | D'Amato et al. | 313/461 |
| 4,985,658 | 1/1991 | Canevazzi . | |
| 5,107,999 | 4/1992 | Canevazzi . | |

*Primary Examiner*—Donald J. Yusko
*Assistant Examiner*—N. D. Patel
*Attorney, Agent, or Firm*—Leydig, Voit & Mayer

[57] ABSTRACT

A CRT having a phosphor layer on the inner surface of a panel wherein the longer side of the phosphor layer is concave with respect to the longer side of the panel, thereby providing a screen which has a rectangular appearance.

9 Claims, 4 Drawing Sheets

CATHODE RAY TUBE

This application is a continuation of application Ser. No. 07/950,493, filed Sep. 25, 1992, now abandoned.

BACKGROUND OF THE INVENTION

The present invention relates to a cathode ray tube, and more particularly to a cathode ray tube having all improved structure of a phosphor layer formed on the inner surface of a curved panel.

Generally, a cathode ray tube (CRT) consists of a neck, a funnel and a panel. An electron gun for emitting electron beams is installed in the neck. A phosphor layer for displaying a picture by means of the electron beams colliding thereon is formed on tile inner surface of the panel. In such a CRT, as shown in FIG. 1, panel 1 has a curved surface. A phosphor layer 2 is formed in the shape of a rectangle on the inner surface of panel 1. More specifically, as shown in FIG. 2, assumed that there is a tangent plane 3 in contact with tile center 0 of panel 1 and the rectangle's longer axis is X and its shorter axis is Y. Distances a and b, both of which are perpendicular to the longer side of phosphor layer 2, are equal. Here, distance a is defined as tile distance from an arbitrary point A on the X axis to a point C on tangent plane 3, while distance b is similarly from an arbitrary point B to a point D.

However, since partel 1 is substantially curved, when phosphor layer 2 is formed as a rectangle as described above, the screen unfavorably appears swollen along the longer sides of the phosphor layer, as shown in FIG. 3.

SUMMARY OF THE INVENTION

Therefore, it is an object of the present invention to provide an improved CRT having an efficient screen which does not appear swollen along its longer sides, that is, looks rectangular.

To accomplish the objects, there is provided a cathode ray tube comprising a phosphor layer on the inner surface of a curved panel and in the shape of a rectangle having a predetermined length to height ratio, wherein, assumed that a tangent plane passes through the center of the panel, the longer axis of which is X and the shorter axis of which is Y, a point F is set at a predetermined location along the longer side of a projected image formed by projecting the phosphor layer to the tangent plane, and a perpendicular distance e is the perpendicular line from point F to the X axis, whereby the phosphor layer is formed to have said projected image in which perpendicular distance e is lengthened from the center of panel to its edge.

In the CRT of the present invention, when the longer side of the projected image is concave with respect to the X axis, that is, when the phosphor layer is formed on the inner surface of the panel to have the projected image in which perpendicular distance e is lengthened from the center of panel to its edge, the edges of the screen appear substantially straight since the panel is convex. This provides viewers with a seemingly rectangular screen. The present invention provides a CRT having a rectangular screen by improving the phosphor shape, thereby enhancing the appearance of a CRT's screen.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
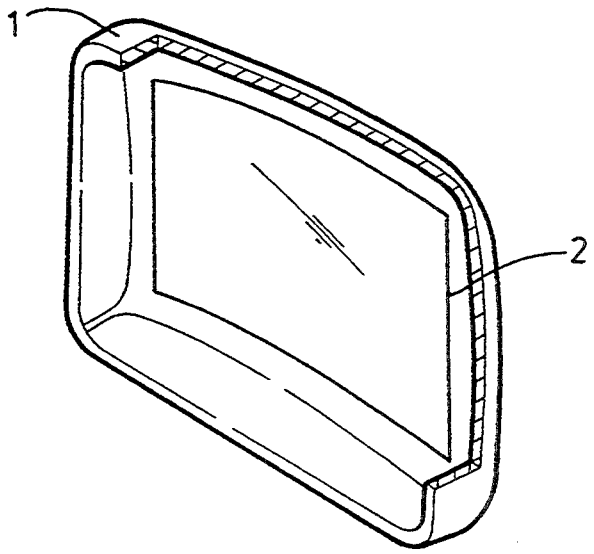
FIG. 1 (PRIOR ART)
FIG. 1 is a partially cut-away, perspective view of a conventional panel, which shows the shape of a phosphor layer formed on the inner surface thereof.
Figure 2:
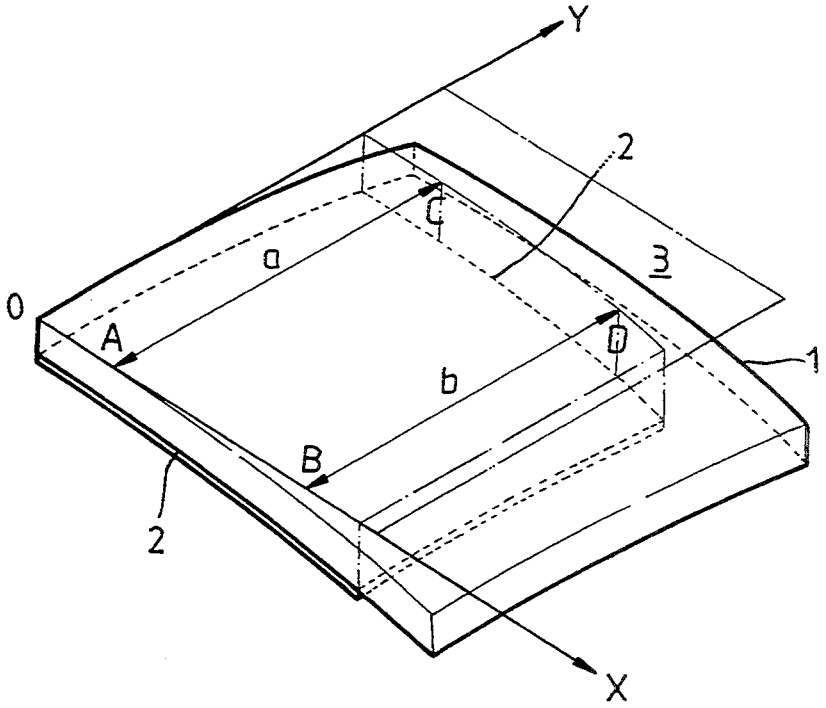
FIG. 2 (PRIOR ART)
FIG. 2 is a schematic view of the upper right portion of the panel shown in FIG. 1.
Figure 3:
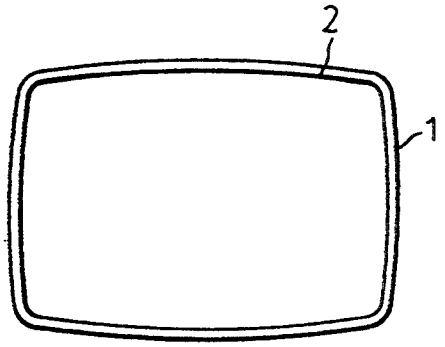
FIG. 3(PRIOR ART)
FIG. 3 is a schematic view of the screen shape resulting from a phosphor layer formed as in FIG. 1.
Figure 4:
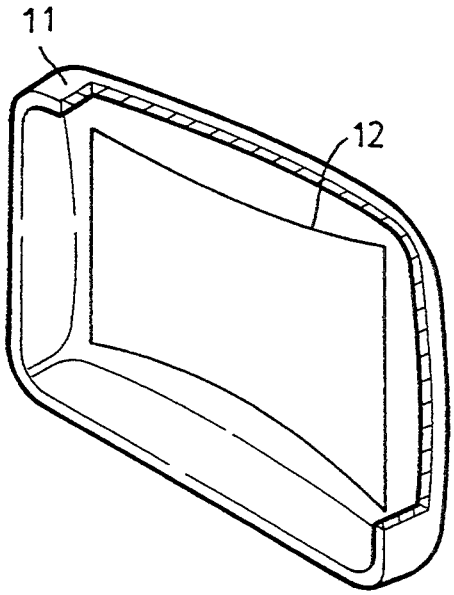
FIG. 4 is partially cut-away, perspective views of a panel, which show the shapes of a phosphor layer formed on the inner surface thereof according to embodiments of the present invention.

Referring to FIG. 4, a panel 11 of CRT according to the present invention is formed to have a predetermined curvature and a predetermined length to height ratio, e.g., the longer side to the shorter side, is 4:3.

First, it is assumed that a plane in contact with the center 0 of panel 11 is a tangent plane 13, the longer axis of the panel passing through the center 0 of panel 11 on tangent plane 13 is X, and the shorter axis of the panel passing through the center 0 of panel 11 on tangent plane 13 is Y. A point F is set at a predetermined location along the longer side of a projected image 12' formed by projecting phosphor layer 12 to tangent plane 13, and a perpendicular distance e is the perpendicular line from point F to X axis. As depicted in FIG. 4, the phosphor layer 12 has the shape of a quadrilateral with first and second opposing sides that are curved toward the center of the quadrilateral.

Figure 6:
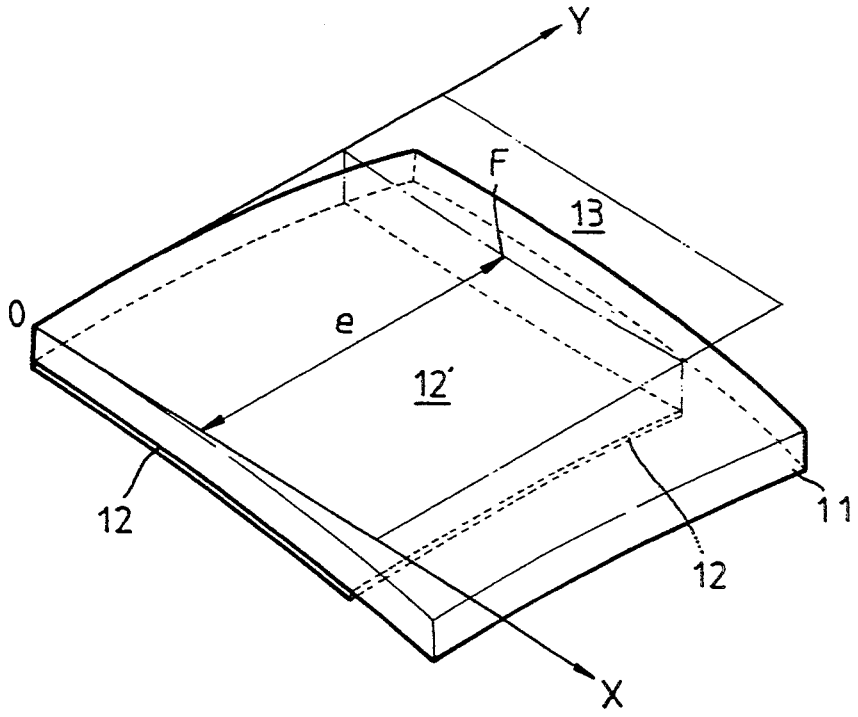
FIG. 6 is a schematic view of the upper right portion of the panel to explain the basic concept of the present invention.
Figure 7:
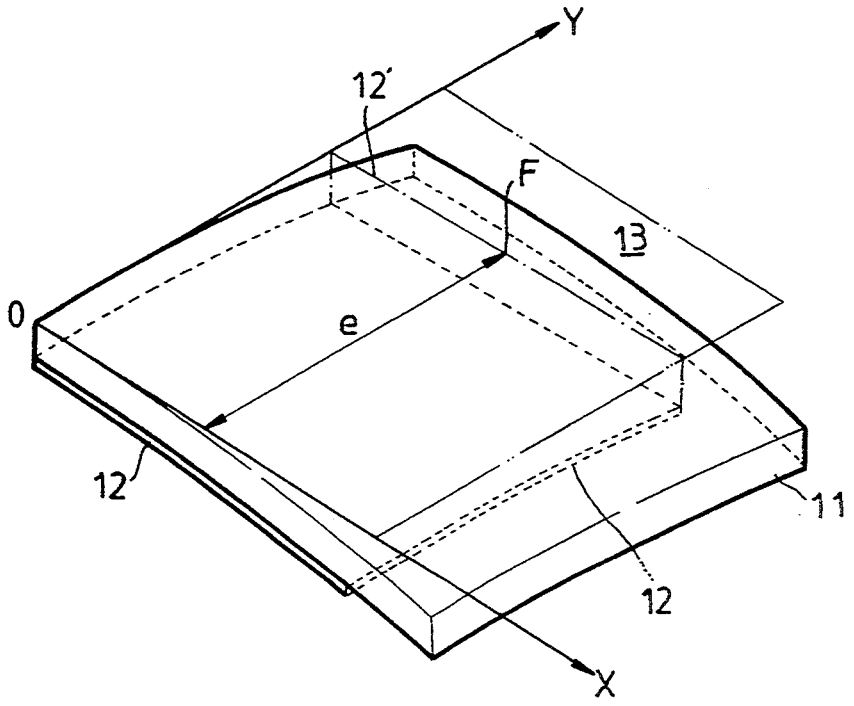
FIG. 7 is a schematic view of the upper right portion of the panel to explain another embodiment of the present invention.

Referring to FIG. 4 and 6, in the present invention, the longer side of projected image 12' is concave with respect to the X axis. Specifically, the greater perpendicular distance e between point F and the X axis becomes (from the center 0 of the panel to its edge), the longer the longer side of projected image 12' becomes. Here, as shown in FIG. 7, the longer side of projected image 12' may be formed of sloped line segments, or may be in the shape of a parabola as in FIG. 6.

Figure 5:
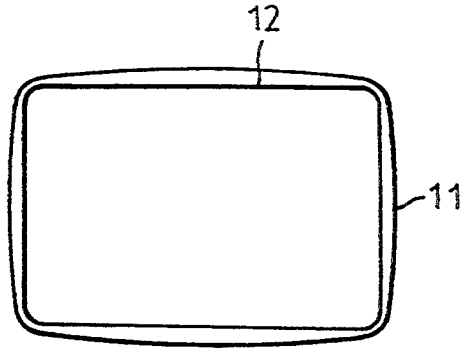
FIG. 5 is a schematic view of the screen shape resulting from a phosphor layer formed as in FIG. 4.

In the CRT of the present invention, when the longer side of projected image 12' is formed to be concave with respect to the X axis as shown in FIG. 4, that is, when phosphor layer 12 is throned on the inner surface of panel 11 to have projected image 12' in which perpendicular distance e (from the center 0 of panel to its edge) becomes longer, as shown in FIG. 5, the edges of the screen appear substantially straight since panel 11 is convex.

As described above in detail, the CRT of the present invention provides seemingly rectangular screens simply by modifying the phosphor layer's shape.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A cathode ray tube comprising:

a curved panel having a center and an inner surface; and a phosphor layer disposed on the inner surface of said curved panel, said phosphor layer having a quadrilateral shape including a first pair of opposing sides and a center, each one of the opposing sides being curved to the center of said phosphor layer, wherein said phosphor layer is shaped such that a plane tangent to a center of said panel includes first and second perpendicular axes and contains a projected image of said phosphor layer and the projected image of the phosphor layer is configured such that a distance measured from one of the axes of the tangent plane to one of the opposing sides of the projected image increases from the center of said panel to an edge of said panel.

2. A CRT as claimed in claim 1, wherein said phosphor layer is formed so that the opposing sides of the projected image are formed of sloped line segments.

3. A CRT as claimed in claim 1, wherein said phosphor layer is formed so that the opposing sides of the projected image are formed in the shape of a parabola.

4. A cathode ray tube as claimed in claim 1 wherein said panel is convex.

5. A screen for a CRT comprising:

a substantially rectangular panel having a curved outer surface and a curved inner surface, the inner and outer surfaces having first and second sides, the first side being longer than the second side and the first side extending in a direction of an X-axis of a plane which is tangent to the center of said panel;

a quadrilateral phosphor layer disposed on the inner surface of said panel having a first pair of opposing sides and a second pair of opposing sides, the first pair of opposing sides said phosphor layer being longer than the second pair of opposing sides said phosphor layer and an image of said phosphor layer projected onto the tangent plane such that the first pair of opposing sides are concave with respect to the X-axis.

6. A screen for a CRT as claimed in claim 5 wherein the first side of said phosphor layer is parabolic.

7. A screen for a CRT as claimed in claim 5 wherein said panel is convex.

8. A screen for a CRT comprising:

a panel having an inner surface and an outer surface, the inner and outer surfaces having first and second sides;

a quadrilateral phosphor layer disposed on the inner surface of said panel having a first pair of opposing sides and a second pair of opposing sides, each one of the first pair of opposing sides curved toward a center of said phosphor layer.

9. A screen for a CRT as claimed in claim 8 wherein each one of the first pair of opposing sides is parabolic.

* * * * *